US006814229B2

(12) United States Patent
Seckler

(10) Patent No.: US 6,814,229 B2
(45) Date of Patent: Nov. 9, 2004

(54) BOTTLE ADAPTER AND ASSOCIATED METHODS

(75) Inventor: Allison Seckler, Boca Raton, FL (US)

(73) Assignee: Belle Bottles LLC, Boca Raton, FL (US)

( * ) Notice: Subject to any disclaimer, the term of this patent is extended or adjusted under 35 U.S.C. 154(b) by 0 days.

(21) Appl. No.: 10/388,083

(22) Filed: Mar. 13, 2003

(65) Prior Publication Data

US 2003/0205548 A1 Nov. 6, 2003

Related U.S. Application Data

(60) Provisional application No. 60/377,538, filed on May 3, 2002.

(51) Int. Cl.[7] ..... B65D 81/32

(52) U.S. Cl. ..... 206/222; 206/217; 206/219; 215/6; 215/DIG. 8

(58) Field of Search ..... 206/217, 219–222, 206/568; 215/6, DIG. 8; 604/416

(56) References Cited

U.S. PATENT DOCUMENTS

| | | | |
|---|---|---|---|
| 2,446,451 | A | 8/1948 | Allen |
| 2,786,769 | A | 3/1957 | Greenspan |
| 2,793,776 | A | 5/1957 | Lipari |
| 2,885,104 | A | 5/1959 | Greenspan |
| 3,289,874 | A | 12/1966 | Dailey et al. |
| 3,796,337 | A | 3/1974 | Seunevel |
| 3,983,994 | A | 10/1976 | Wyslotsky |
| 4,193,506 | A | 3/1980 | Trindle et al. |
| 4,678,092 | A | 7/1987 | Rane |
| 4,711,359 | A | 12/1987 | White et al. |
| 4,823,946 | A | 4/1989 | Stoeffler et al. |
| 4,830,205 | A | 5/1989 | Hammond et al. |
| 4,961,495 | A | 10/1990 | Yoshida et al. |
| 4,982,880 | A | 1/1991 | Angeloz et al. |
| 5,000,314 | A | 3/1991 | Fuller et al. |
| 5,273,171 | A | 12/1993 | Steele-Rowland et al. |
| 5,275,298 | A | 1/1994 | Holley, Jr. et al. |
| 5,277,303 | A | 1/1994 | Goyet et al. |
| 5,419,445 | A | 5/1995 | Kaesemeyer |
| 5,540,341 | A | 7/1996 | Holley et al. |
| 5,579,935 | A | 12/1996 | Atkin et al. |
| 5,638,968 | A | 6/1997 | Baron et al. |
| 5,678,709 | A | 10/1997 | Holley et al. |
| D390,964 | S | 2/1998 | Mercer et al. |
| 5,758,786 | A | 6/1998 | John |
| 5,788,369 | A | 8/1998 | Tseng |
| 5,794,802 | A | 8/1998 | Caola |
| 5,950,689 | A | 9/1999 | Varlet |
| 6,089,389 | A | 7/2000 | Sharon et al. |
| 6,113,257 | A | 9/2000 | Sharon et al. |
| 6,126,032 | A | 10/2000 | Herzog et al. |
| 6,138,847 | A | 10/2000 | Johnson |
| 6,244,452 | B1 | 6/2001 | Morano et al. |

OTHER PUBLICATIONS

On–the–Go Baby Products [online]. Umix Products, Inc., 2001 [retrieved on Mar. 6, 2003]. Retrieved from the Internet:<URL: www.umixbaby.com/default.asp>.

*Primary Examiner*—Jim Foster
(74) *Attorney, Agent, or Firm*—Allen, Dyer, Doppelt, Milbrath & Gilchrist, P.A.

(57) ABSTRACT

A bottle adapter includes a connector having a containment region for holding a composition and an internal threaded portion that engages threads on a bottle neck and has an opening in fluid communication with the containment region. An upper end of the connector has an aperture that is in fluid communication with the containment region. The adapter also includes a first seal for sealing an opening in the threaded portion and a second seal for sealing the aperture. In use a removal of the first seal permits fluid communication between the containment region and fluid in the bottle, permitting the formation of a mixture. A removal of the second seal permits the mixture to be dispensed. Methods for storing a composition for subsequent mixing with a fluid and for delivering a mixture of a composition and a fluid are also addressed.

21 Claims, 4 Drawing Sheets

BOTTLE ADAPTER AND ASSOCIATED METHODS

CROSS-REFERENCE TO RELATED APPLICATION

This application claims priority to provisional patent application No. 60/377,538, "Disposable Bottle Adapter," filed on May 3, 2002.

BACKGROUND OF THE INVENTION

1. Field of the Invention

The invention relates generally to storage containers and methods of utilizing the same. In particular, the storage containers and methods are adapted to provide a fitted attachment to bottles.

2. Related Art

It is sometimes desirable to keep plural ingredients separated until they can be mixed and dispensed. For example, when using powdered baby formula, the user may mix a formula with water to produce a nutritional liquid to be consumed by infants and small children. Once the liquid formula is prepared, it is preferable that it be consumed within a short period of time or discarded to prevent the ingestion of spoiled formula.

Central to this process is the accurate measurement of dry powdered formula to water in appropriate proportions. Accurate measurement eliminates the potential for error resulting in the inadequate feeding of a child, which can lead to a condition known as "failure to thrive," a well-documented cause of poor weight gain in infants and toddlers.

When an infant is taken out of the home, such as during travel or while in day care, feeding times are generally not precisely known, and infants are often fed on demand. Under these conditions, feeding a child using powdered formula can become complicated and untidy, as the user is required to measure out the appropriate amount of formula from a formula container and add it to a baby bottle containing water. Formulas can be premixed and stored in a portable insulated carrier; however, it is recommended that the premixed formula be consumed within a few hours. If the formula is not consumed in a timely fashion, it can be subject to separation or spoilage. Moreover, the measurement process imposes an increased risk of contamination or cross-contamination between the feeding utensils and the child.

Placing a cold pack or ice in a portable insulated carrier with the formula can extend the consumption period. However, if the formula is kept at a cool temperature or refrigerated, it is usually necessary to heat the formula to at least room temperature in order to have it accepted by the child. Powdered baby formula and water, each in separate containers at room temperature, have a much longer shelf life than when mixed together. Prolonged shelf life is effective in reducing costs.

Typically, infant formula is either mixed in batch form or individually in baby bottles. Powdered baby formula in present use requires a mixing ratio of water to powder. When the water and formula are mixed, the total volume does not equal the sum of the individual parts. This is due to the air that is contained in the volume of the powdered formula, as well as its structure. When mixed with water, the water fills in any space the air once occupied and additionally causes the powder to dissolve and diffuse in the water.

A number of containers for storing, mixing, and dispensing have been described in the prior art. However, none of the known devices is easy to clean, nor is any known for use in connection with water bottles. In addition, known designs include many parts, adding complexity to the construction of the device and its cleaning by the user. An abundance of parts also demands higher costs and increases the probability of losing parts that could render the device inoperative. Moreover, commercially available disposable nursing systems most frequently include a flexible liner that is inserted into a rigid plastic holder, although pre-mixed glass bottles are also available. Typically, the liner incorporates an open end to be wrapped about a portion of the plastic holder. Formula must be purchased for placement in the flexible liner by the user, who must then stretch a pre-sterilized nipple over the flexible liner and the top of the holder. After the nipple is secured to the holder, a securing ring is typically placed to provide additional fastening for the nipple.

These procedures also have several disadvantages. The user must expend great energy and time to ensure cleanliness, particularly for a very young infant. The nipple must be sterilized in a separate operation. Furthermore, the possibility of contamination during the transfer of the formula into the liner is present. Additionally, spillage is common where the nipple is mounted on the holder. Moreover, the use of a glass baby bottle for feeding an infant includes the risk of bottle breakage. The resulting fragments of the glass bottle can pose a danger to those near the location of the breakage, including the infant and those responsible for feeding the infant. Finally, the requirements of "making a bottle" demonstrate the need for a self-contained device that can eliminate the necessity for the sterilization of component parts (such as nipples), boiling water, measuring formula, and cleaning the component parts.

Accordingly, a need exists for a bottle adapter that allows for a predetermined amount of formula to be contained under sterile conditions therein. Additionally, a disposable bottle adapter is needed that can connect a disposable water bottle to a nipple assembly in order to simplify the mixing of infant formula with water.

A need also exists for a bottle adapter that contains a composition for subsequent mixing with a fluid in a bottle to which the adapter is connectable. Further, a need exists for such a bottle adapter that has a longer shelf life than premixed compositions, is lighter, and is easier to carry.

SUMMARY OF THE INVENTION

The present invention addresses the above-mentioned needs for a bottle adapter that contains a predetermined amount of a composition, and is adapted to connect a bottle to a drinking assembly in order to simplify the on-demand mixing of accurate quantities of the composition with a fluid.

The adapter of the present invention comprises a connector having an outer wall defining a containment region therewithin. The containment region is adapted to hold a composition. The connector also has an internal threaded portion that is adapted to engage an external threaded section on a neck portion of a bottle. The threaded portion has an opening at a top end, the opening in fluid communication with the containment region. The threaded portion also defines at least an upper portion of a passageway between the top end thereof and a lower end of the connector. An upper end of the connector has an aperture that is in fluid communication with the containment region.

The adapter also comprises a first sealing member for achieving a fluid-tight seal with the threaded portion's opening and a second sealing member for achieving a fluid-tight seal with the aperture.

In use a removal of the first sealing member permits fluid communication between the containment region and the fluid in the bottle, thereby permitting the formation of a mixture of the composition and the fluid. A removal of the second sealing member permits removal of the mixture from the containment region and the bottle.

The present invention also addresses an adapter and drinking assembly apparatus for connecting with a bottle having a threaded neck portion and for permitting the separate storage of a composition for subsequent mixing with a fluid contained in the bottle. This apparatus comprises a drinking assembly that comprises a fluid delivery member at a top end. The fluid delivery member has a fluid passageway that extends from an opening in the fluid delivery member to an opening at a bottom end. The apparatus also comprises a connector such as that described above.

Also addressed by the present invention is a fluid mixing and delivery apparatus, which comprises a bottle having a neck portion having an external threaded section and an opening at a top end, in addition to the apparatus described above.

A method of storing a composition for subsequent mixing with a fluid is additionally provided. The method comprises the steps of placing a composition in a containment region of a connector. The connector has an internal threaded portion that is adapted to engage an external threaded section on a neck portion of a bottle, the threaded portion having an opening at a top end. The opening is in fluid communication with the containment region. The threaded portion defines at least an upper portion of a passageway between the top end thereof and a lower end of the connector. Next the threaded portion opening and the aperture are sealed.

A method of delivering a mixture of a composition and a fluid is also provided. This method comprises the steps of removing a first seal between a containment region of a connector and a bottle. The connector has an internal threaded portion that is adapted to engage an external threaded section on a neck portion of a bottle. The threaded portion defines at least an upper portion of a passageway between the top end thereof and a lower end of the containment region. The containment region contains a composition, and the bottle contains a fluid.

Next the composition and the fluid are permitted to mix to form a mixture. A second seal that seals an aperture between the containment region and an area external to the containment region is then removed, and the mixture is dispensed from the aperture.

DETAILED DESCRIPTION OF THE PREFERRED EMBODIMENTS

Figure 1:
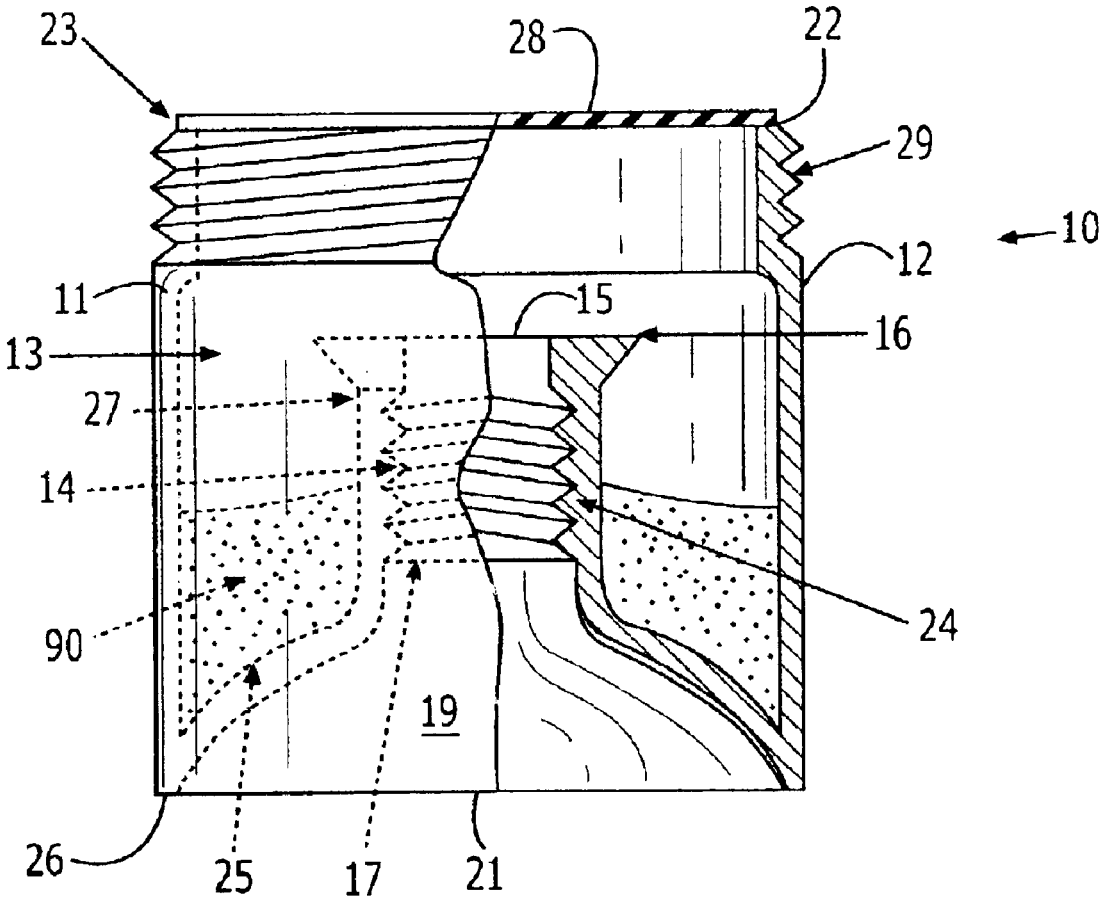
FIG. 1 is a front view of the adapter of the present invention.

The present invention will now be discussed with reference to FIGS. 1–3.

A first aspect of the present invention addresses an adapter 10 (FIG. 1) for connecting with a bottle 61,61' (FIGS. 2A and 2B) and for permitting the separate storage of a composition 90 for subsequent mixing with a fluid 91 contained in the bottle 61,61'.

In a preferred embodiment, the adapter 10 comprises a connector 11 having an outer wall 12 that defines a containment region 13 therewithin for holding a composition 90. Such a composition may comprise, but is not intended to be limited to, a powder such as an infant formula or water-mixable drink preparation such as a beverage mix, a nutritional supplement, or a medication. Typically the composition 90 is capable of forming a solution or suspension, particularly an aqueous solution or suspension. An internal threaded portion 14 is adapted to engage an external threaded section 63 on a neck portion 62 of the bottle 61,61'. The threaded portion 14 has an opening 15 at a top end 16, and a first length 24 between the top end 16 and a bottom end 17 that is opposed to the first end 16. The opening 15 is in fluid communication with the containment region 13, and the threaded portion 14 defines at least an upper portion of a passageway 19 between the top end 16 of the threaded portion 14 and a lower end 21 of the connector 11. An upper end 22 of the connector 11 has an aperture 23 that is in fluid communication with the containment region 13.

The upper end 22 of the connector 11 also comprises means for engaging with a drinking assembly 50,50', for example, but not intended to be limited to, an external threaded portion 29.

The connector 11 also has a bottom face 25 that meets the lower edge 26 of the outer wall 12 at its outer perimeter.

The adapter 10 also comprises a first sealing member for achieving a fluid-tight seal with the threaded portion's opening 15. The first sealing member may comprise, for example, a frangible seal 27 positioned adjacent the threaded portion's top end 16. Alternatively, the first sealing member comprises a removable and replaceable seal. Other embodiments may also be envisioned by one of skill in the art, such as a dissolvable seal or a seal that has an aperture that is alignable with an aperture in an element with which the adapter 10 is matable.

The adapter 10 additionally comprises a second sealing member for achieving a fluid-tight seal with the aperture 23. The second sealing member may comprise, for example, a frangible seal 28 positioned adjacent the connector's upper end 22. Alternatively, the second sealing member comprises a removable and replaceable seal.

Both the first and second sealing member may be attached by a nontoxic adhesive; alternatively, they may be formed from the same material that forms the internal threaded portion 14 and the external threaded portion 24. Preferably the connector 11 is disposable, and deliverable to a user with the composition 90 already sealed within the containment region 13.

Figure 2A:
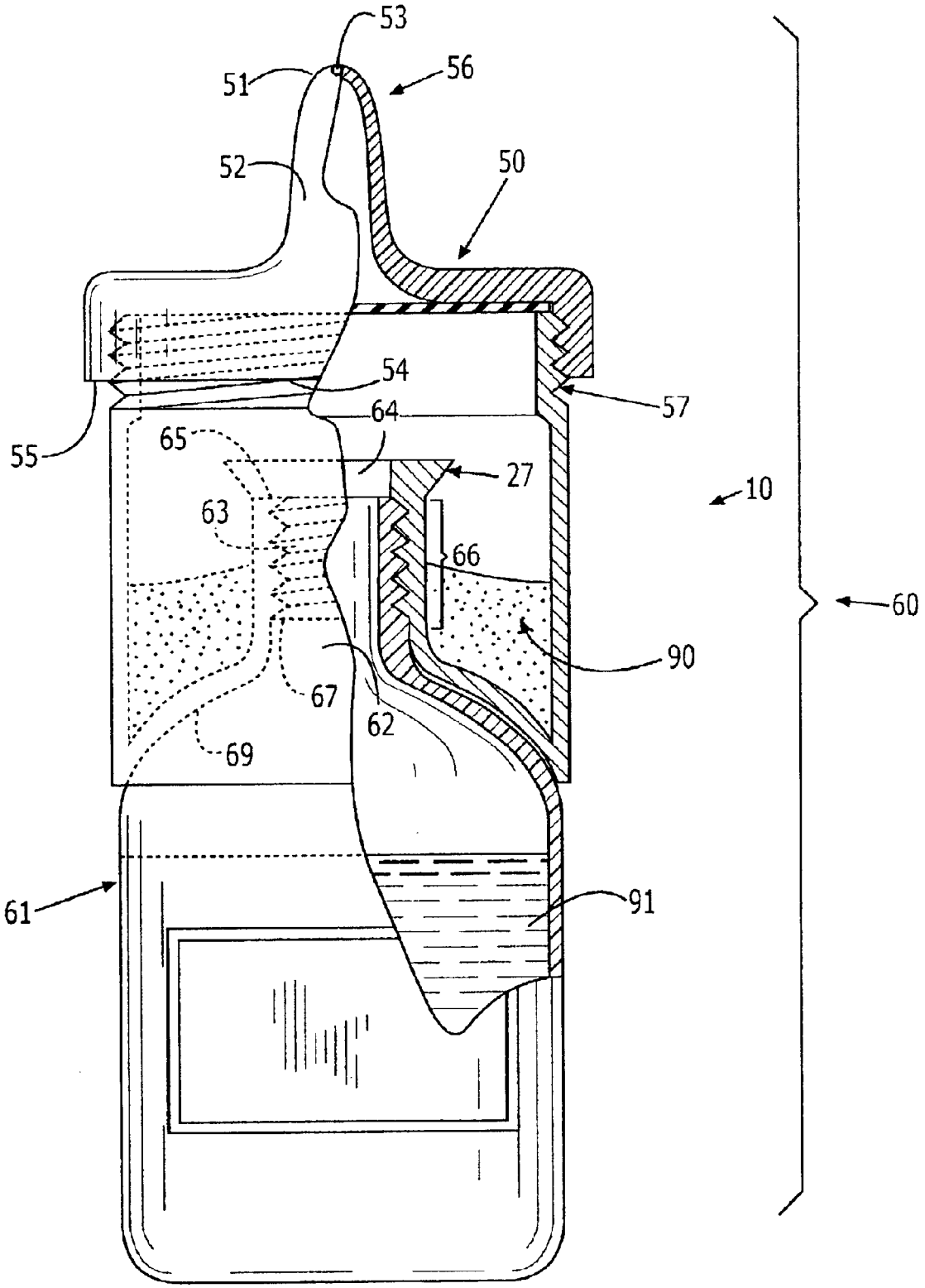
FIG. 2A is a front view of the fluid mixing and delivery apparatus of the present invention.
Figure 2B:
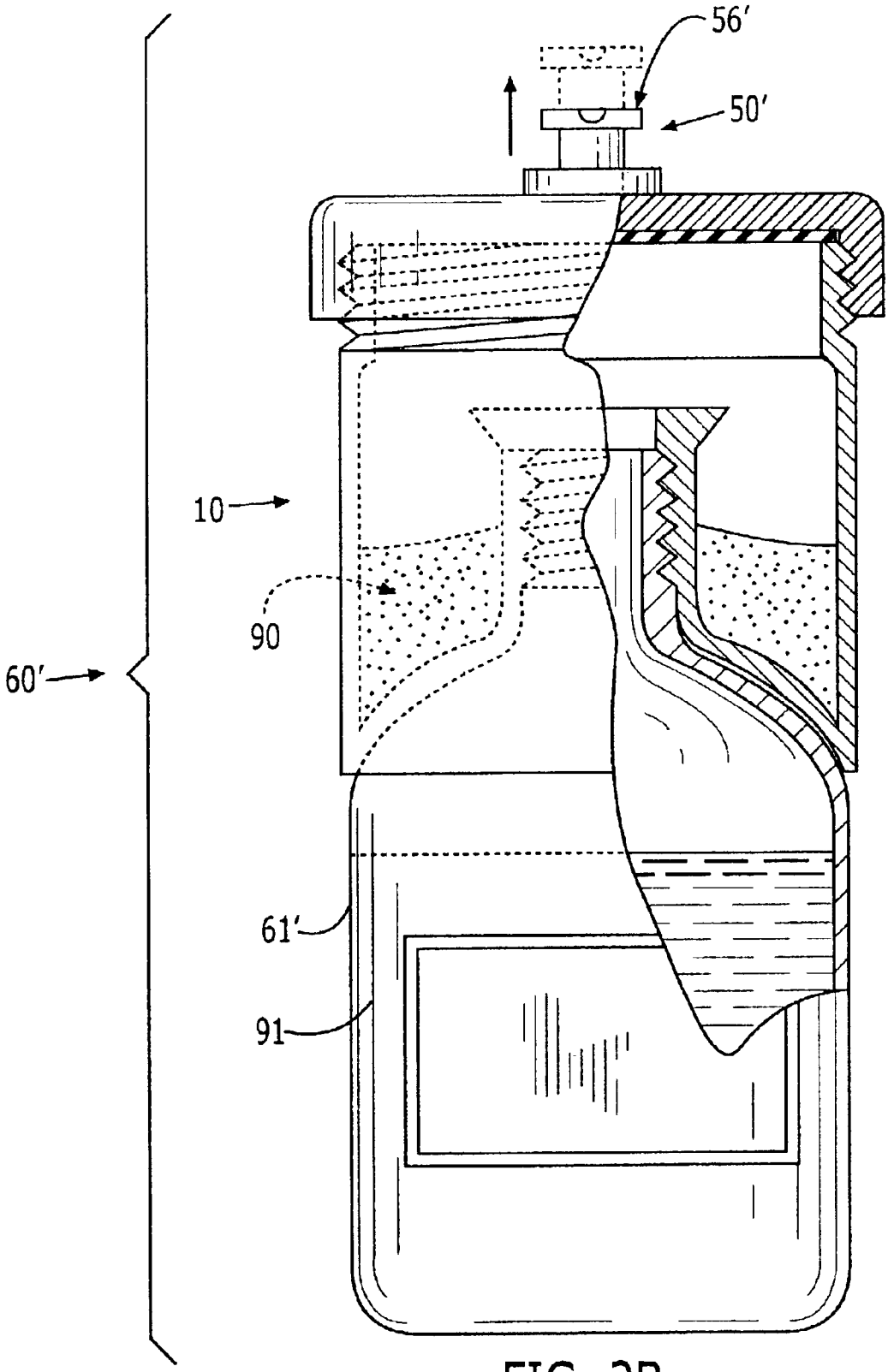
FIG. 2B is a front view of an alternate embodiment of the fluid mixing and delivery apparatus

A second aspect of the invention addresses an adapter and drinking assembly for connecting with a bottle 61,61' (FIGS. 2A and 2B). The drinking assembly comprises a fluid delivery member at a top end 51 and has a fluid passageway 52 extending from an opening 53 in the fluid delivery member to an opening 54 at a bottom end 55. In the embodiment illustrated in FIG. 2A, the drinking assembly comprises a baby bottle cap 50 such as known in the art, and the fluid delivery member comprises a nipple 56 affixed to the cap 50. Here the engaging means of the connector 11 comprises an external threaded portion 29 that is adapted to engage with the internal threaded portion 57 of the cap 50.

In a second embodiment shown in FIG. 2B, the drinking assembly comprises a bottle cap 50', and the fluid delivery member comprises a spout 56' such as is known in the art for delivering, for example, bottled water and sports drinks. The spout 56' is movable between an open position wherein fluid passage is permitted (shown in dotted lines) and a closed position wherein fluid passage is inhibited.

A third aspect of the invention addresses a fluid mixing and delivery apparatus 60,60'. The apparatus 60,60' comprises, in addition to the drinking assembly 50,50' and the adapter 10 discussed above, a bottle 61 having a neck portion 62. The bottle 61 may be disposable. The neck portion 62 has an external threaded section 63, an opening 64 at a top end 65, and a second length 66 between the top end 65 and the bottom end 67. In a preferred embodiment wherein the first sealing member comprises a frangible seal 27, this second length 66 is larger than the first length 24, so that, when fully engaged, the top end 65 of the bottle neck 62 extends beyond the connector threaded portion's top end 16, serving to remove the seal 27 and permitting the contents of the containment region 13 and the bottle 61 to mix.

Figure 3:
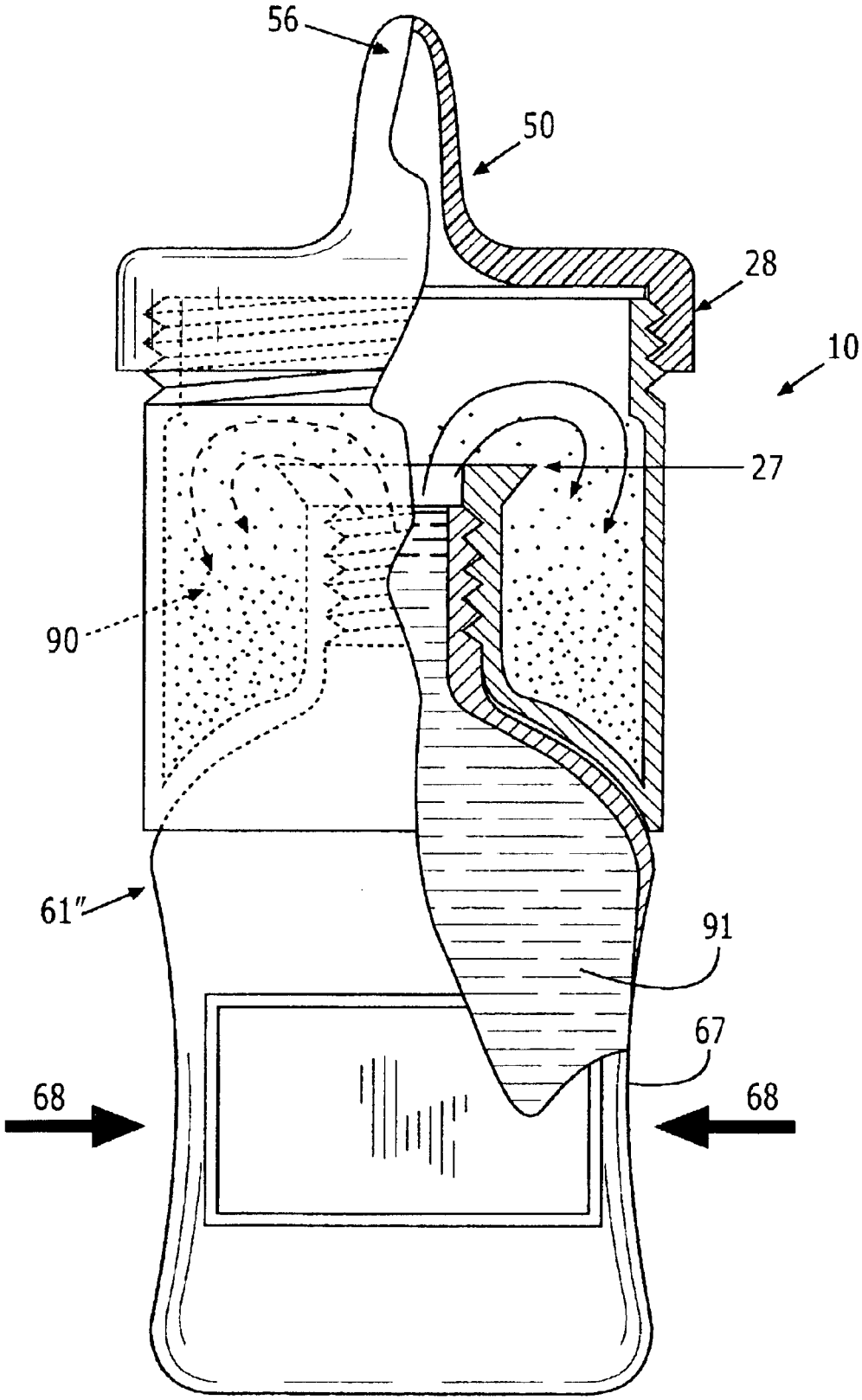
FIG. 3 illustrates one embodiment of the mixing step of an aspect of the method of the present invention.

In another embodiment, the bottle 61" comprises a deformable bottle (FIG. 3). Under sufficient pressure to the sides 67 of the bottle 61", fluid pressure is applied as shown by the arrows 68, causing the frangible seal 27 to rupture, again permitting the contents of the containment region 13 and the bottle 61" to mix. In this embodiment, the second sealing member also comprises a frangible seal 28, which is ruptured under sufficient pressure on the bottle 61", permitting the contents of the containment region 13 the bottle 61" to be dispensed through the nipple 56 or spout 56'.

Preferably the bottom face 25 of the connector 11 comprises a depression 26 that is configured to engage at least a portion of the shoulder region 69 and neck 62 of the bottle 61,61',61". A central region of the depression 26, which leads to the threaded portion 14, comprises the passageway 19. In the case of a baby bottle 61 (FIG. 2A), for example, the connector's bottom face 25 substantially conforms to the shoulder region 69 of the baby bottle 61; likewise for the spouted bottle 61' (FIG. 2B).

The present invention also addresses several associated methods. A first method is for storing a composition 90 for subsequent mixing with a fluid 91. This method comprises the step of placing a composition 90 in a containment region 13 of a connector 11 as described above and sealing the threaded portion's opening 15 and the aperture 23.

A second method is for delivering a mixture of a composition 90 and a fluid 91. This method comprises the step of removing a first seal 27 between a containment region 13 of a connector 11 and a bottle 61,61' such as described above. The composition 90 and the fluid 91 are permitted to mix to form a mixture. Additional manipulation, such as shaking, may be employed to ensure complete mixing. A second seal 28 sealing an aperture 23 between the containment region 13 and an area external to the containment region 13 is removed, and the mixture is dispensed from the aperture 23.

In a particular embodiment the composition 90 comprises an infant formula, the fluid 91 comprises water, and the bottle 61 comprises a baby bottle. In this case, the dispensing step comprises permitting the mixture to flow from the aperture 23 into a baby bottle cap 50 and thence from a nipple 56 affixed to the baby bottle cap 50. Alternatively, a non-infant drink could be dispensed, such as a mixture of a powdered drink preparation or a syrup with water, although these are not intended as limitations.

Although only a few exemplary embodiments of the present invention have been described in detail above, those skilled in the art will readily appreciate that numerous modifications are to the exemplary embodiments are possible without materially departing from the novel teachings and advantages of this invention. Accordingly, all such modifications are intended to be included within the scope of this invention as defined in the following numbered paragraphs.

What is claimed is:

1. An adapter for connecting with a bottle having a threaded neck portion and for permitting the separate storage of a composition for subsequent mixing with a fluid contained in the bottle, the adapter comprising:

a connector having an outer wall defining a containment region therewithin, the containment region adapted to hold a composition, an internal threaded portion adapted to engage an external threaded section on a neck portion of a deformable bottle, the threaded portion having an opening at a top end, the opening in fluid communication with the containment region, the threaded portion defining at least an upper portion of a passageway between the top end thereof and a lower end of the connector, and an upper end having an aperture in fluid communication with the containment region;

a first sealing member for achieving a fluid-tight seal with the threaded portion opening; and a frangible seal positioned adjacent the connector upper end for achieving a fluid-tight seal with the aperture, the frangible seal removable under fluid pressure applied by deformation of the bottle;

wherein in use a removal of the first sealing member permits fluid communication between the containment region and the fluid in the bottle, thereby permitting the formation of a mixture of the composition and the fluid, and a removal of the second sealing member permits removal of the mixture from the containment region and the bottle.

2. The adapter recited in claim 1, wherein the connector upper end comprises means for engaging with a drinking assembly.

3. The adapter recited in claim 2, wherein the engaging means comprises means for engaging with a baby bottle cap.

4. The adapter recited in claim 2, wherein the engaging means comprises an external threaded portion for engaging with an internal threaded portion of the drinking assembly.

5. The adapter recited in claim 1, wherein the threaded portion has a first length between the top end and a bottom end opposed to the top end, the first length smaller than a second length between a top end of the bottle neck threaded section and a bottom end opposed to the bottle neck top end.

6. The adapter recited in claim 5, wherein the first sealing member comprises a frangible seal positioned adjacent the threaded portion top end, the frangible seal removable by a mating of the connector with the bottle neck sufficient to cause the bottle neck top end to extend beyond the threaded portion top end.

7. The adapter recited in claim 1, wherein the first sealing member comprises a frangible seal positioned adjacent the threaded portion top end, the frangible seal removable under fluid pressure applied by deformation of the bottle.

8. The adapter recited in claim 1, wherein the first sealing member comprises a removable and replaceable seal.

9. An adapter for connecting with a bottle having a threaded neck portion and for permitting the separate storage of a composition for subsequent mixing with a fluid contained in the bottle, the adapter comprising:

a connector having an outer wall defining a containment region therewithin, the containment region adapted to hold a composition, an internal threaded portion adapted to engage an external threaded section on a neck portion of a bottle, the threaded portion having an opening at a top end, the opening in fluid communication with the containment region, the threaded portion defining at least an upper portion of a passageway between the top end thereof and a lower end of the connector, an upper end having an aperture in fluid communication with the containment region, and a bottom face meeting a lower edge of the outer wall at an outer perimeter thereof, the bottom face comprising a depression configured to engage at least a portion of a shoulder region and the neck of the bottle, a central region of the depression comprising the passageway;

a first sealing member for achieving a fluid-tight seal with the threaded portion opening; and a second sealing member for achieving a fluid-tight seal with the aperture;

wherein in use a removal of the first sealing member permits fluid communication between the containment region and the fluid in the bottle, thereby permitting the formation of a mixture of the composition and the fluid, and a removal of the second sealing member permits removal of the mixture from the containment region and the bottle.

10. The adapter recited in claim 9, wherein the bottom face is configured to engage at least a portion of a shoulder region and the neck of a baby bottle, and the threaded portion is adapted to engage the external threaded section of the baby bottle neck.

11. An adapter and drinking assembly apparatus for connecting with a bottle having a threaded neck portion and for permitting the separate storage of a composition for subsequent mixing with a fluid contained in the bottle, the apparatus comprising:

a drinking assembly comprising a fluid delivery member at a top end and having a fluid passageway extending from an opening in the fluid delivery member to an opening at a bottom end;

a connector having an outer wall defining a containment region therewithin, the containment region adapted to hold a composition, an internal threaded portion adapted to engage an external threaded section on a neck portion of a deformable bottle, the threaded portion having an opening at a top end, the opening in fluid communication with the containment region, the threaded portion defining at least an upper portion of a first passageway between the top end thereof and a lower end of the connector, and an upper end having an aperture in fluid communication with the containment region and means for mating with the bottom end of the drinking assembly defining a second passageway between the containment region and the fluid passageway of the drinking assembly;

a first sealing member for achieving a fluid-tight seal with the threaded portion opening; and a frangible seal positioned adjacent the threaded portion top end, the frangible seal removable under fluid pressure applied by deformation of the bottle, for achieving a fluid-tight seal with the aperture;

wherein in use a removal of the first sealing member permits fluid communication between the containment region and the fluid in the bottle, thereby permitting the formation of a mixture of the composition and the fluid, and a removal of the second sealing member permits dispensing of the mixture from the containment region and the bottle through the fluid delivery member opening.

12. The apparatus recited in claim 11, wherein the mating means comprises an external threaded portion and the drinking assembly bottom end comprises an internal threaded portion adapted for engaging with the connector external threaded portion.

13. The apparatus recited in claim 12, wherein the drinking assembly comprises a baby bottle cap and the fluid delivery member comprises a nipple.

14. The apparatus recited in claim 13, wherein the drinking assembly comprises a bottle cap and the fluid delivery member comprises a spout movable between an open position wherein fluid passage is permitted and a closed position wherein fluid passage is inhibited.

15. The apparatus recited in claim 11, wherein the threaded portion has a first length between the top end and a bottom end opposed to the top end, the first length smaller than a second length between a top end of the bottle neck threaded section and a bottom end opposed to the bottle neck top end.

16. The apparatus recited in claim 15, wherein the first sealing member comprises a frangible seal positioned adjacent the threaded portion top end, the frangible seal removable by a mating of the connector with the bottle neck sufficient to cause the bottle neck top end to extend beyond the threaded portion top end.

17. The apparatus recited in claim 11, wherein the first sealing member comprises a frangible seal positioned adjacent the threaded portion top end, the frangible seal removable under fluid pressure applied by deformation of the bottle.

18. The apparatus recited in claim 11, wherein the first sealing member comprises a removable and replaceable seal.

19. An adapter and drinking assembly apparatus for connecting with a bottle having a threaded neck portion and for permitting the separate storage of a composition for subsequent mixing with a fluid contained in the bottle, the apparatus comprising:

a drinking assembly comprising a fluid delivery member at a top end and having a fluid passageway extending from an opening in the fluid delivery member to an opening at a bottom end;

a connector having an outer wall defining a containment region therewithin, the containment region adapted to hold a composition, an internal threaded portion adapted to engage an external threaded section on a neck portion of a bottle, the threaded portion having an opening at a top end, the opening in fluid communication with the containment region, the threaded portion defining at least an upper portion of a first passageway between the top end thereof and a lower end of the connector, an upper end having an aperture in fluid communication with the containment region and means for mating with the bottom end of the drinking assembly defining a second passageway between the containment region and the fluid passageway of the drinking assembly, and a bottom face meeting a lower edge of the outer wall at an outer perimeter thereof, the bottom face comprising a depression configured to engage at least a portion of a shoulder region and the neck of the bottle, a central region of the depression comprising the first passageway;

a first sealing member for achieving a fluid-tight seal with the threaded portion opening; and a second sealing member for achieving a fluid-tight seal with the aperture;

wherein in use a removal of the first sealing member permits fluid communication between the containment region and the fluid in the bottle, thereby permitting the formation of a mixture of the composition and the fluid, and a removal of the second sealing member permits dispensing of the mixture from the containment region and the bottle through the fluid delivery member opening.

20. The apparatus recited in claim 19, wherein the bottom face is configured to engage at least a portion of a shoulder region and the neck of a baby bottle, and the threaded portion is adapted to engage the external threaded section of the baby bottle neck.

21. A fluid mixing and delivery apparatus comprising:

a deformable baffle having a neck portion having an external threaded section and an opening at a top end;

a drinking assembly comprising a fluid delivery member at a top end and having a fluid passageway extending from an opening in the fluid delivery member to an opening at a bottom end;

an adapter comprising:

a connector having an outer wall defining a containment region therewithin, the containment region adapted to hold a composition, an internal threaded portion adapted to engage the baffle neck external threaded section, the threaded portion having an opening at a top end, the opening in fluid communication with the containment region, the threaded portion defining at least an upper portion of a first passageway between the top end thereof and a lower end of the connector, and an upper end having an aperture in fluid communication with the containment region and means for mating with the bottom end of the drinking assembly defining a second passageway between the containment region and the fluid passageway of the drinking assembly;

a first sealing member for achieving a fluid-tight seal with the threaded portion opening; and a frangible seal positioned adjacent the connector upper end for achieving a fluid-tight seal with the aperture, the frangible seal removable under fluid pressure applied by deformation of the bottle;

wherein in use a removal of the first sealing member permits fluid communication between the containment region and the fluid in the bottle, thereby permitting the formation of a mixture of the composition and the fluid, and a removal of the second sealing member permits dispensing of the mixture from the containment region and the bottle through the fluid delivery member opening.

* * * * *